US005632136A

United States Patent [19]

Luchenbill et al.

[11] Patent Number: 5,632,136

[45] Date of Patent: May 27, 1997

[54] WIRE WINDING APPARATUS

[75] Inventors: Wayne A. Luchenbill, Leesburg; Danny J. Kelley, Kimmell; David P. Houser, Ligonier; James A. Horn, North Webster, all of Ind.

[73] Assignee: Flex-Ohm, Inc., Cromwell, Ind.

[21] Appl. No.: 460,050

[22] Filed: Jun. 2, 1995

[51] Int. Cl.[6] ..... D02G 3/38

[52] U.S. Cl. ..... 57/18; 57/10; 242/441.4

[58] Field of Search ..... 57/3, 18, 10; 242/441.4

[56] References Cited

U.S. PATENT DOCUMENTS

| | | | |
|---|---|---|---|
| 445,598 | 2/1891 | McCahey | 57/18 |
| 463,389 | 11/1891 | Liddell | 57/18 |
| 1,375,655 | 4/1921 | Heany | 57/18 |
| 1,565,868 | 12/1925 | Stoll | 57/18 |
| 1,668,758 | 5/1928 | Bryant | 57/18 |
| 2,533,460 | 12/1950 | Huck | 57/18 |
| 2,910,822 | 11/1959 | Bunch | 57/18 |
| 3,035,395 | 12/1962 | Bohannon, Jr. | 57/19 |
| 3,635,421 | 1/1972 | Wray | 57/22 |
| 3,729,913 | 5/1973 | Boland et al. | 242/118.6 |
| 5,038,458 | 8/1991 | Wagoner et al. | 29/599 |

*Primary Examiner*—Katherine Matecki
*Attorney, Agent, or Firm*—Taylor & Associates, P.C.

[57] ABSTRACT

The invention is directed to an apparatus for winding resistance wire about a filament core. The apparatus includes a plurality of wire supply reels supported by a frame, each wire supply reel having an axial bore extending therethrough and carrying a length of the wire. A filament core is threaded through each of the wire supply reels with a mechanism for directing the filament core between the wire supply reels. The filament core extends through a winding station operable to rotate one of the wire supply reels about the filament core so that wire carried on the wire supply reel is wound about the filament core. The wire supply reel is formed from a cylinder having a flange at each end. The cylinder and flanges together have a continuous slot in communication with the axial bore to permit the threaded filament to exit from the axial bore when the wire supply is exhausted.

11 Claims, 3 Drawing Sheets

WIRE WINDING APPARATUS

BACKGROUND OF THE INVENTION

1. Field of the Invention

The present invention relates to wire winding apparatus, and, more particularly, an apparatus for winding a resistance wire about a core material.

2. Description of the Related Art

Resistance wire elements are sometimes made by forming a resistance wire (nichrome for example) in a helical pattern around a central string or filament core. The wire is designed by controlling the resistance of the winding wire. The resistance of the wire is controlled by varying the length of the alloy about the filament core by wrapping more or less turns per inch around the core.

A problem with the prior art is that mass quantities of such wound wire could not be created since prior machines could only hold a finite amount of supply reels, normally held in a straight line. An additional problem in the art is that of needing long runs of the resistance wire for the automobile industry. Filament core length of 20,000 to 25,000 ft. long are typically used, limited only by the supply of winding wire utilized.

In the prior art, such as U.S. Pat. No. 5,038,458, the filament core had to be cut to load more supply wire reels. That patent discloses a method of manufacture of a non-uniform heating element in which a core filament 13 is passed through a rotating spool of heater wire 31. Rotating spool 31 is controlled via a motor 41 to wrap wire at a proper rate versus the translational speed of the core filament 13, thereby controlling the winding density (windings per inch) of the wire about the filament.

Another problem with conventional winding apparatus designs is that of removing the exhausted reels of winding wire. Prior wire supply reels were constructed of plastic and pre-threaded on the filament core, prior to beginning the winding process. As one supply reel was emptied, the machine would stop and an operator would smash or fracture the reel to remove it from the filament. The operator would then slide a fresh reel from a holding area onto the winding machine.

U.S. Pat. No. 3,729,913 to Wray discloses a cylindrical body 10 including a slot 22 formed therein. However, cylindrical body 10 does not carry a continuous thread or filament, rather the continuous thread is carried by a bobbin 26. Cylindrical body 10 is driven by a gear wheel 18 which results in wrapping of the continuous thread from bobbin 26 about the core material. The continuous thread is not wrapped around cylindrical body 10.

U.S. Pat. No. 3,635,421 to Boland discloses a reel having a slot in each disc-shaped end thereof. However, the reel does not include a slot which extends through the hub and communicates with each radially extending slot of the disc-shaped ends. Rather, the hub includes a complicated structure including a plurality of fingers and recesses which interfit with each other to lock the hubs together. Such a reel is expensive to manufacture and the fingers may eventually wear out through use.

The present invention is directed to eliminate the necessity of breaking or fracturing the wire supply reels, while additionally providing structure to permit an increased number of wire supply reels available for use.

SUMMARY OF THE INVENTION

The present invention provides an apparatus for manufacturing a wound wire by combining a large number of wire supply reels into a rack-type frame. A filament core is threaded through each of the wire supply reels or spools with an interfitting means for directing the filament between the wire supply reels. A winding station is provided, through which the filament core extends, and is operable to rotate one of the wire supply reels about the filament core so that wire carried on the wire supply reel is wound about the filament core.

The present invention solves the problem of insufficient winding wire supply by permitting the wire supply reels to be oriented in any direction other than a strictly linear fashion as was previously accomplished.

In another form of the invention, a wire supply reel for a winding machine includes a cylinder with a flange at each end. The cylinder has an axial bore therethrough. A radial slot through the cylinder permits removal of the reel from the filament core without cutting the filament core or fracturing the reel. The radial slot permits the reel, when empty, to slide sideways and away from the filament core.

An advantage of the present invention is that longer filament core supplies may be utilized, thereby reducing machine downtime, and improving efficiencies.

Another advantage is that utilization of the new supply reel configuration reduces the necessity to smash or fracture the wire supply reels for removal, thereby reducing the chance of severing the filament core and permitting reuse and recycling of the supply reel. This further reduces the cost of machine operation.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, in which.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
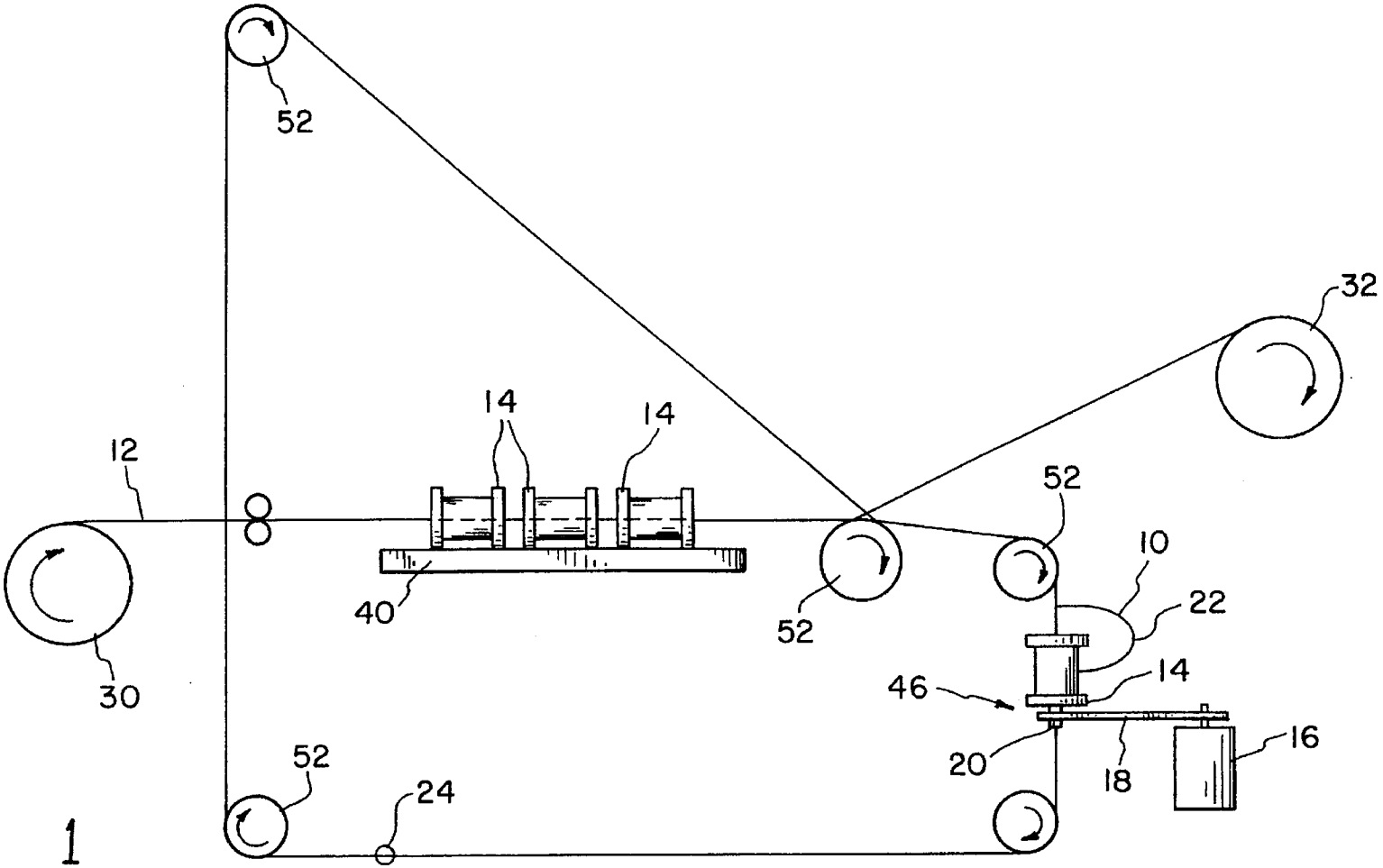
FIG. 1 is a schematic illustration of a wire winding apparatus for forming resistance wire about a filament core.

Referring now to the drawings and particularly to FIG. 1, there is shown an embodiment of a wire winding apparatus of the present invention utilized in forming a flexible, resistance wire that could be used as heating resistance wire or as spark plug wires for automobiles. The wound resistance wire is formed by winding wire 10 about a strand or filament core 12 with a controllable variable pitch. The flexible elongate resistance element produced has a strip of resistance wire 10 formed about the flexible elongated filament core 12. Filament core 12 can be of a conductive or non-conductive material. Wire 10 may be of copper or other electrically conductive materials.

An apparatus and method of manufacturing a resistance wire element is shown in FIG. 1. The resistance wire element is made by forming wire 10 about elongate core 12 of material in a generally helical pattern by moving core 12 in an axially downward direction as viewed in its direction of elongation while paying out resistance wire 10 in a circular motion about the core as it is drawn through a winding station. A resistance wire pay-out reel 14 is driven by motor 16 by way of a V-belt 18 which is entrained on a pulley 20 connected to reel 14, thereby causing reel 14 to rotate about its longitudinal axis. Wire 10 forms a loop 22 bowed outwardly by centrifugal force as loop 22 revolves about filament core 12. The motion of wire 10 is somewhat similar to the twirling of a lariat; however, wire 10 is continuously payed out from the pay-out reel 14 and taken up at the other end of the loop as wire 10 forms itself about core 12. The direction of rotation of reel 14 is such as to tend to wind wire 10 from reel 14 and the combination of forces acting on wire 10 maintain a fairly constant loop length for a given reel speed. The combination of these two motions, which is known as served wire winding, is effective to lay resistance wire 10 in a helical pattern about core 12.

The wire pay-out reel 14 is removably mounted onto a hollow shaft spindle (not shown) which is, in turn, supported on a bearing in which reel 14 and the spindle are free to rotate. The spindle includes pulley 20, with motor 16 and V-belt 18 together forming a winding station 46.

A supply spool 30 supplies filament core 12 to the process while wire wound core material is taken up by a motor driven take-up reel 32. Any change in the relative speeds of motor 16 and motor driven take-up reel 32 will vary the relationship between the speed at which core 12 is moved and the rotational speed of wire 10, and thereby varies the pitch of the helical pattern created. The length of core 12 between spool 30 and reel 32 may be maintained under tension by imposing a friction drag (not shown) on spool 30 such as by pulleys or by other means, if desired. Core tension may also be achieved by passing the core through a restricted opening or die as shown in U.S. Pat. No. 5,038,458, which is explicitly hereby incorporated herein by reference. Such tensioning of filament core 12 will stretch core 12 and reduce a transverse core dimension in a direction oblique to the direction of core movement.

Since variations in spindle speed tend to change the force on (and the shape of) loop 22, typically, the speed of the circular motion of the spindle and reel 14 is held constant and the speed at which core 12 is moved is either increased or decreased to vary the pitch of helical pattern.

The rotational speeds of motor 16 and take-up reel 32 are controlled by a computer control unit (not shown). This control unit also receives input information from an electric eye or other sensor 24 which determines if wire 10 is wound about core 12. Alternatively, if an ohmic sensor is used, this control unit periodically samples the resistance of a predetermined length of the resistance wire created.

Figure 2:
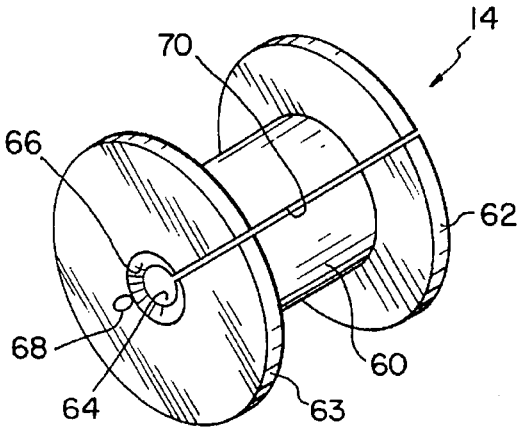
FIG. 2 is a perspective view of an embodiment of the wire winding reel of the invention.
Figure 4:
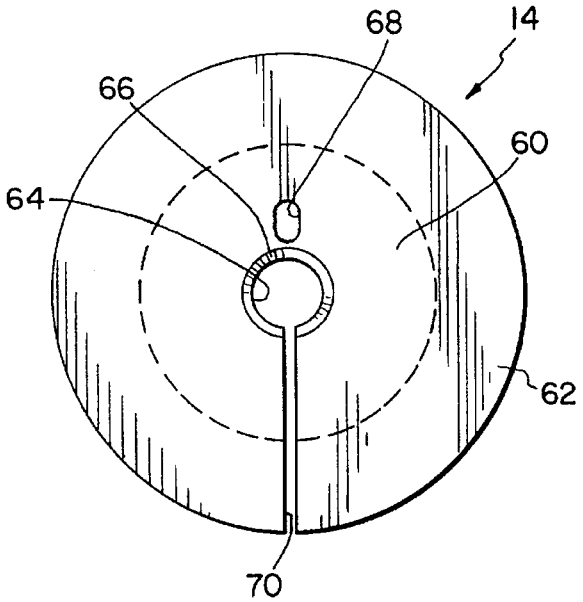
FIG. 4 is a plan view of the wire winding reel of FIG. 2.
Figure 3:
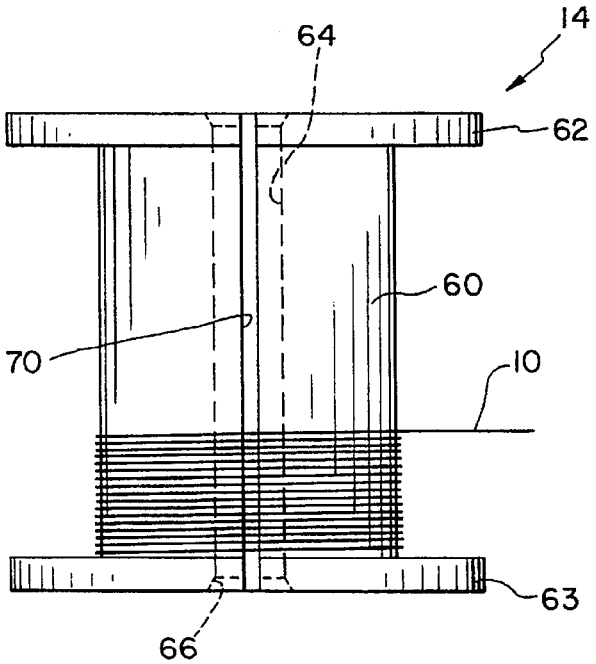
FIG. 3 is an elevational view of the wire winding reel of FIG. 2.

Wire supply reel 14, as shown in FIGS. 2–4, includes a unique design to permit quick and instantaneous removal from conventional winding station 46 when empty. Wire reel 14 is preferably constructed from a cylinder 60 of metal, such as aluminum, although it could be constructed from plastic or other composites. Cylinder 60 includes two disc-shaped flanges 62 and 63, and substantially forms the shape of a spool. Cylinder 60 further includes an axial bore 64 centered along its longitudinal axis. Flanges 62 and 63 may be countersunk forming countersunk areas 66 adjacent to axial bore 64. A recess 68 may be formed in one or both flanges 62, 63 to provide an area into which a portion of the spindle may interfit to rotatably drive reel 14.

A feature of wire supply reel 14 is that of a continuous radial slot 70 that passes through cylinder 60 and each flange 62 and 63. As shown in FIGS. 2–4, slot 70 is parallel and in communication with axial bore 64 to permit a filament core 12 threaded through reel 14 to be removed therefrom, thereby permitting reel 14 to be removed from flexible core 12 without the necessity of breaking or fracturing reel 14 or cutting core 12. The locations through which radial slot 70 extends through flanges 62 and 63 are aligned radially relative to axial bore 64. Radial slot 70 has a sole necessary requirement of being totally through cylinder 60 to permit a wire threaded through axial bore 64 to pass and escape sideways from cylinder 60. In FIGS. 2–4 radial slot 70 is parallel with axial bore 64, although it is not a requirement. Radial slot 70 may be non-parallel to axial bore 64 thereby creating a type of skewed slot 70 in spiral communication with axial bore 64 while still passing through both flanges 62 and 63.

Figure 6:
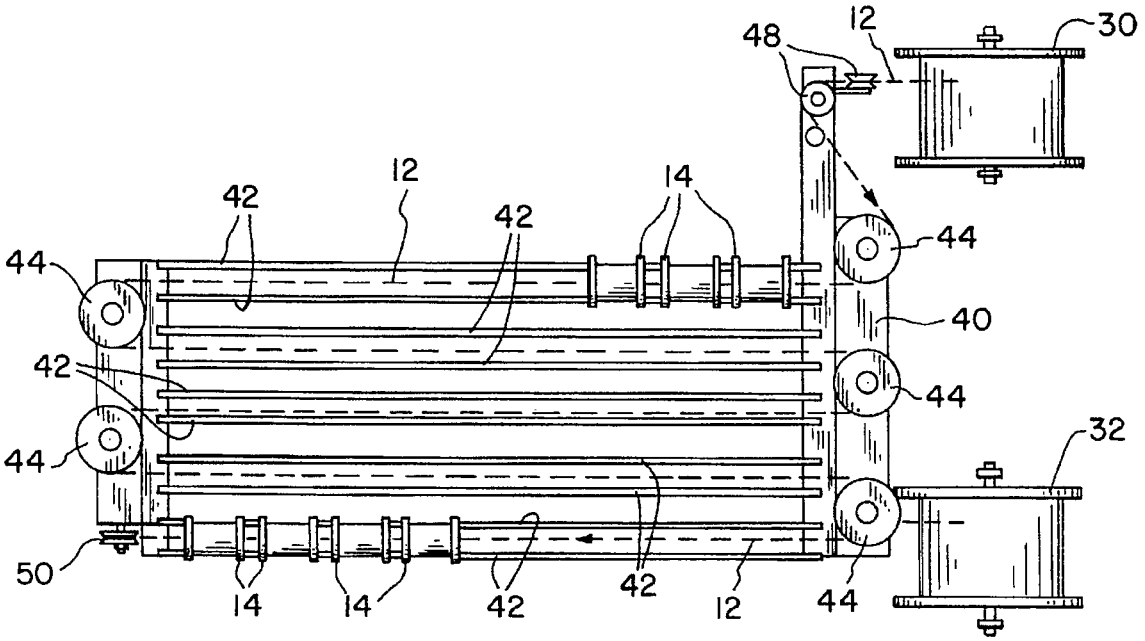
FIG. 6 is a plan view of the wire winding apparatus of FIG. 5.
Figure 5:
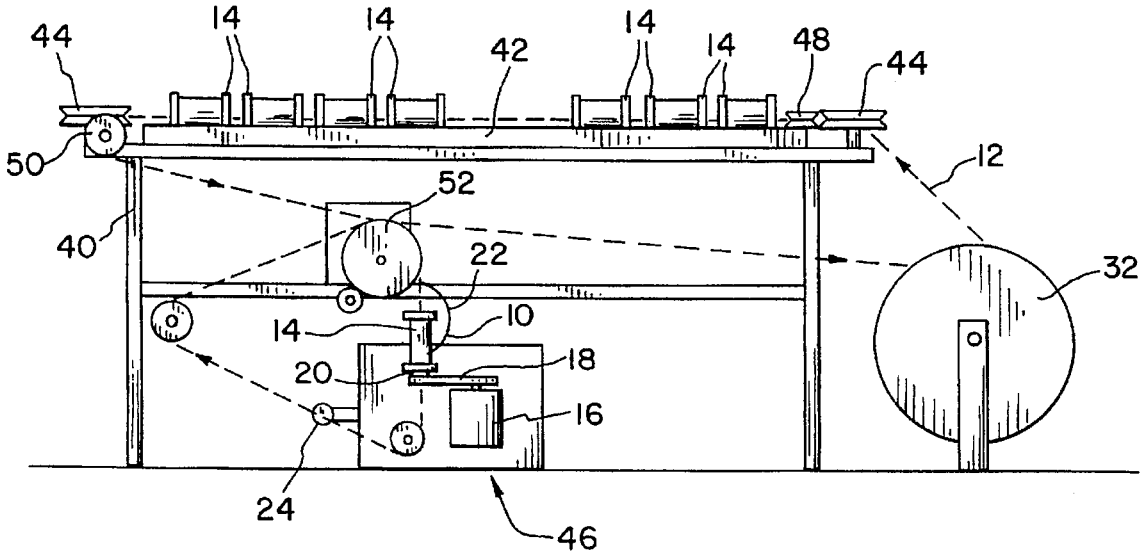
FIG. 5 is an elevational front view of another embodiment of a wire winding apparatus for forming resistance wire about a filament core.

Referring now to FIG. 5 and 6, another embodiment of the invention is shown. Frame 40 includes a plurality of rack members 42 that support wire supply reels 14 through which filament core 12 is threaded. It is possible to provide a relatively large number of wire supply reels 14 along rack members 42, six of which are shown in FIG. 6. In FIG. 6, for clarity of the drawings, the majority of the wire supply reels 14 are not shown. Frame 40 creates the ability to combine a great many rows of wire supply reels 14.

A mechanism is utilized between and about wire supply reels 14 for directing filament core 12 therethrough. In a preferred form of the invention, pulleys 44 are utilized to cause a change of direction of filament core 12 to pass through a first one group or row of wire supply reels 14 and then another group or row of wire supply reels 14. As is shown in FIG. 6, a plurality of pulleys 44 may be utilized to increase the density of wire supply reels 14 within a given area of floor space or volume. As shown in FIG. 5, a winding station 46 is utilized to wind resistance wire 10. A benefit of utilizing the apparatus as disclosed is that rack members 42 support at least two substantially parallel rows of wire supply reels 14, thereby increasing the supply of wire 10 permitting an increased length of filament core 12 to be utilized. In other words, the mechanism provides that at least two wire supply reels 14 may be disposed non-coaxially relative to each other, thereby permitting larger amounts of wire 10 to be pre-loaded on the winding apparatus.

Additionally during use, if all of the rack members 42 are not filled with reels 14, it is possible to eliminate core 12 from running side-to-side through frame 40 by only selectively using some of the pulleys 44, such as by simply releasing core 12 from them. For example, with reference to FIG. 6, if only the two bottom rack members 42 were utilized for a particular winding operation, an operator could remove core 12 from pulleys 44 along the left side of the machine. The selective use of pulleys 44 prevents having long lengths of filament core 12 which is not threaded through reels 14, but nonetheless traverses frame 40 from side-to-side.

Referring again to FIG. 6, flexible filament core 12 exits from spool 30 through small alignment pulleys 48 to a first pulley 44 which causes filament core 12 to bend or change direction into alignment with two rack members 42 which contain a plurality of reels 14, only three of which are shown. As filament core 12 passes through these supply reels 14, it encounters a second pulley 44 at an opposite end of rack members 42 which thereby again causes the direction of flexible core 12 to change and become oriented in with another set of rack members 42. At an opposite end of frame 40 is another alignment pulley 50 which causes filament core 12 to be oriented for entry and adjustment about a guide pulley 52 which thereby directs filament core 12 through reel 14 of winding station 46. Filament core 12, now wound with wire 10, from wire supply reel 14 is guided to and wound about motor driven take-up reel 32.

In operation, as a wire reel 14 is emptied, a sensor such as an electric eye 24 as shown in FIG. 5, located adjacent to wound filament core 12 notifies the controller that the currently mounted wire supply reel 14 is empty. At that time, the computer causes motors 16 and 32 to stop. The exhausted wire supply reel 14 is slid sideways with filament core 12 passing through radial slot 70, thereby releasing reel 14 from core 12. Then, an operator threads a new wire supply reel 14 from a pair of top rack members 42 about pulleys 44, guide member 52, and into place adjacent sprocket 20. The ends of the wire on the wrapped filament core 12 and the new supply reel 14 are tied together. The winding apparatus is then reset and reactivated to proceed with the winding operation. Thus, it is possible to provide a relatively long length of wire wound filament core without the necessity or likelihood of severing the filament core.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for manufacturing a wound wire including a filament core with a wire wound around the filament core, said apparatus comprising:

a plurality of wire supply reels, each said wire supply reel having a flange on each end and an axial bore extending entirely therethrough, each said wire supply reel and said flanges having together a continuous slot in communication with said axial bore, each said wire supply reel carrying a length of the wire, the filament core threaded through each said wire supply reel;

a frame including a plurality of rack members which support said wire supply reels, said rack members being aligned to support rows of said wire supply reels; and a winding station through which the filament core extends, said winding station being operable to rotate one of said wire supply reels about said filament core so that wire carried on said wire supply reel is wound about the filament core.

2. The apparatus of claim 1, further comprising means for directing the filament core between said wire supply reels.

3. The apparatus of claim 2, wherein said directing means comprises a pulley to change the direction of the filament core between said wire supply reels.

4. The apparatus of claim 1, wherein said rack members are aligned to support at least two substantially parallel rows of wire supply reels.

5. The apparatus of claim 1, wherein said wire supply reels consist essentially of metal.

6. The apparatus of claim 1, wherein said wire supply reels consist essentially of aluminum.

7. An apparatus for manufacturing a wound wire by rotating wire supply reels containing wire about a flexible, elongate filament core, said apparatus comprising:

a plurality of wire supply reels with the filament core being threaded through each said wire supply reel, at least two of said wire supply reels being disposed non-coaxially relative to each other;

means for directing the filament core between said reels; and a frame including a plurality of rack members which support said wire supply reels, said rack members being aligned to support at least two substantially parallel rows of said wire supply reels.

8. The apparatus of claim 7, wherein said directing means comprises a pulley to change the direction of said filament core between said wire supply reels.

9. An apparatus for manufacturing a wound wire including a filament core with a wire wound around the filament core, said apparatus comprising:

a frame including at least two rows of rack members, said rack members being configured to support a plurality of wire supply reels, the wire supply reels threaded with the filament core and located in two separate rows; and means for directing the filament core between said rows of rack members.

10. The apparatus of claim 9, wherein said directing means comprises a pulley to change the direction of the filament core between said rows of rack members.

11. The apparatus of claim 9, wherein said rack members are aligned to support at least two substantially parallel rows of wire supply reels.

* * * * *